US005636454A

United States Patent [19]

Shida

[11] Patent Number: 5,636,454

[45] Date of Patent: Jun. 10, 1997

[54] TENTERING OVEN FOR STRETCHING FILM AS IT CONVEYS THROUGH AN AIRSTREAM DIRECTED AT ITS TOP AND BOTTOM SURFACE

[75] Inventor: Katsuo Shida, Ibaraki, Japan

[73] Assignee: Oji-Yuka Synthetic Paper Co., Ltd., Tokyo, Japan

[21] Appl. No.: 694,179

[22] Filed: Aug. 8, 1996

[30] Foreign Application Priority Data

Oct. 20, 1995 [JP] Japan ..... 7-295911

[51] Int. Cl.[6] ..... F26B 13/00

[52] U.S. Cl. ..... 34/643; 34/646

[58] Field of Search ..... 34/414, 444, 508, 34/638, 643, 646, 660

[56] References Cited

U.S. PATENT DOCUMENTS

| | | | |
|---|---|---|---|
| 2,591,621 | 4/1952 | Shegda | 34/646 |
| 2,894,334 | 7/1959 | Thygeson, Sr. | 34/646 |
| 4,152,479 | 5/1979 | Larsen | 428/224 |
| 4,815,181 | 3/1989 | Dornier et al. | 34/646 X |
| 5,059,265 | 10/1991 | Asakura | 156/64 |
| 5,129,163 | 7/1992 | Yamazaki et al. | 34/646 |
| 5,285,582 | 2/1994 | Kouchi et al. | 34/638 |
| 5,287,637 | 2/1994 | Dixit et al. | 34/646 |

*Primary Examiner*—John M. Sollecito
*Assistant Examiner*—Steve Gravini
*Attorney, Agent, or Firm*—Oblon, Spivak, McClelland, Maier & Neustadt, P.C.

[57] ABSTRACT

A tentering oven comprises a heating furnace and a tenter. The heating furnace has multiple plenum ducts juxtaposed above and below a film in a direction perpendicular to the flow of the film for blowing hot air to heat the film. The tenter stretches the film transversely and comprises clip bodies, clip levers and liners provided on linked chains, as well as rails composed of chain directing rail members that progressively depart away from each other and a chain drive member. An oil pan is provided beneath a joint of the rail members and each of the plenum ducts is provided in such a way that the hot air discharge port of the ducts is not positioned immediately below the oil pan so as to ensure that the hot air blown from the plenum duct does not make direct contact with the bottom of the oil pan.

9 Claims, 7 Drawing Sheets

COMPARATIVE EXAMPLE

INVENTION

TENTERING OVEN FOR STRETCHING FILM AS IT CONVEYS THROUGH AN AIRSTREAM DIRECTED AT ITS TOP AND BOTTOM SURFACE

BACKGROUND OF THE INVENTION

1. Field of the Invention

The present invention relates to a tentering oven used to manufacture biaxially stretched resin films such as biaxially stretched polypropylene (BOPP) films, biaxially stretched polystyrene (BOPS) films and synthetic papers. The tentering oven includes a stretching hot air oven (including an annealing hot air oven), a cooling furnace and a tenter, and is capable of producing stretched films having a satisfactory thickness profile in a transverse direction, while ensuring that the oil used to lubricate the chains in the tenter and which passes through a joint between rail members to flow down under gravity will not foul the film being stretched.

2. Discussion of the Background

A thermoplastic resin film containing a fine inorganic powder is first stretched in a machine direction using the difference in peripheral speed among rolls; subsequently, at least one side of the longitudinally stretched film is melt-laminated with another thermoplastic resin film containing a fine inorganic powder; after cooling, the laminate is heated to a stretching temperature, then stretched transversely on a tenter and heat set; following further cooling, a surface of the heat set assembly is optionally subjected to corona discharge treatment, thereby producing a sheet of synthetic paper. This related process is described in U.S. Pat. No. 4,318,950 and FIG. 2 accompanying this patent shows an apparatus for producing such synthetic paper.

There is also a related process for producing a low-temperature heat-sealed film suitable for use in packages such as cigarette cartons and candy boxes. The process comprises first stretching polypropylene film with a heat-melted film of a propylene-ethylene copolymer having a lower melting point than the polypropylene in a machine direction after cooling, heating the laminate and then stretching the laminate on a tenter in a transverse direction at a temperature lower than the melting point of the polypropylene but higher than the melting point of the copolymer and thereafter heat treating the biaxially stretched film laminate.

A related process for producing a pearly film comprises first stretching a resin film containing a fine inorganic powder in a machine direction on a series of rolls, then stretching the film in a transverse direction on a tenter and heat setting the biaxially stretched film (see U.S. Pat. No. 3,765,999).

In these methods of producing synthetic papers, low-temperature heat-sealed laminate films and pearly films, the temperature of the annealing hot air oven is set to be slightly higher than that of the stretching hot air oven in the tentering oven. The stretching oven is sometimes an integral part of the heat treatment oven and, as shown in FIG. 1 (as shown in FIG. 2 of Examined Japanese Patent Publication No. 9130/1992), a resin film 1 being supplied in these ovens is heated by a plurality of plenum ducts 2, 2, . . . (i.e., 9 plenums) which have a length substantially the same as the transverse width of the resin film 1 and which are positioned both above and below the resin film such that hot air as supplied from the ducts 2, 2, . . . is passed through discharge ports 3, 3, . . . to be blown against the resin film 1.

The hot air is supplied from conduits 5, 5, . . . to the plenum ducts and then passed through the discharge ports 3, 3, . . . to be blown against the resin film 1 to heat it.

As shown in FIG. 2 (corresponding to FIG. 9 in Examined Japanese Patent Publication No. 9130/1992), the stretching hot air oven 10 also contains two rows of plenum ducts 2, the upper row consisting of 4 plenum ducts and the lower row consisting of 3 plenum ducts. The plenum ducts in the annealing hot air oven are interconnected with conduits 5 via holes 6 in the back surfaces of individual plenum ducts, the plenum ducts in the stretching hot air oven are interconnected with another group of conduits 5 via holes 6 in the back surfaces of those plenum-ducts. The individual conduits 5 are supplied with air that has been heated after aspiration with a blower. The temperature of the heated air (hot air) is typically about 170° C. in the stretching hot air oven 10 and about 175° C. in the annealing hot air oven 11 if the film is made of polypropylene.

The stretched film emerging from the stretching and heating zones enters a cooling zone, where it is cooled with air blown from plenum ducts (as shown in Examined Japanese Patent Publication No. 63498/1991).

The resin film which was typically at 160° C. in the annealing oven is cooled in the cooling furnace such that it leaves the exit thereof at 30° to 50° C.

In the tentering oven, the film is heated while at the same time is stretched with the tenter by a stretch ratio of 4 to 12 in a transverse direction (TD) which is perpendicular to a machine direction (MD), or the flow of the film.

As shown in Examined Japanese Patent Publication No. 18513/1975, the tenter comprises principally clip bodies, clip levers and liners provided on linked chains, as well as rails composed of chain directing rail members that progressively depart away from each other and chain drive means (a motor).

A clip used in a tenter-type stretching machine is shown in FIGS. 3(*a*), 3(*b*) and comprises linked chains 12 and 13 carrying a clip 14 thereon. The clip 14 is basically composed of a clip body 15, a clip lever 16 and liner 17 carried on the clip body 15. At the entrance of the tentering oven, the clip 14 clips a film 1 to be stretched transversely. The thus clipped film is thermally stretched and heat set as it is advanced through the oven at a controlled temperature and at the exit of the tentering oven, the stretched film is released from the clip lever 16 such that it is disengaged from the clip 14 and transferred to wind-up and other subsequent steps.

In order to achieve the intended stretch ratio in TD, a multiple of rail members 18 (FIG. 4) (usually available in lengths of 1.5 meters and 3 meters) are joined together. In areas where changes in width are frequent, rail members 1.5 m long are used; on the other hand, 3-m long rail members are used in areas where the stretching pattern is fixed.

As shown in FIGS. 6, 7(*a*) and 7(*b*), an oil 22 used to lubricate chains 12 and 13 drips down through a joint 19 (see FIG. 4) between rail members 18. In order to prevent the dripping oil from fouling the film 1, an oil pan 20 was placed below the individual joints 19 as shown in FIG. 4. It was then necessary that the discharge port 2*a* of a plenum duct located below each oil pan be provided with a blind patch 50 (see FIG. 4) in order to prevent the oil into the entrance of the duct while ensuring that the hot air coming through the discharge port will not impinge against the oil pan to create a turbulent flow that will scatter the oil drops.

However, it has been found that if both ends of the discharge port are provided with a blind patch 50, the ends of the film are heated less than the central portion and the uniformity in the thickness profile of the stretched film in the direction of its width (in transverse direction) is reduced—the deviation is ±4.0 μm on an 80 μm thick film. It has also been found that even if the blind patch 50 is fitted, oil drops 22' will adhere to the stretched film when 45 to 60 days have passed since the beginning of the stretching operation. Stated more specifically, the oil leaking from the upper holder flows down the walls to collect in drops 22' (see FIG. 6) under the rails and the supplied hot air will cause such oil drops to fly about within the tentering oven, thereby fouling the film being stretched.

Therefore, if oil drops are detected on the surface of the stretched film 1, the operation of the molding machine has to be stopped so that the tenter can be cleaned. The interval of tenter cleaning operations ranges from 1.5 to 2 months and, even if the molding machine is restatted after the cleaning of the tenter, it .usually takes about 12 hours to establish a steady-state operation.

SUMMARY OF THE INVENTION

An object, therefore, of the present invention is to provide a tentering oven that is free from the problem of oil drops (mist) and which is capable of producing stretched films of an improved thickness profile.

The stated object of the present invention can be attained by a tentering oven comprising a heating furnace and a tenter. The heating furnace has multiple plenum ducts juxtaposed above and below a film in a direction perpendicular to the flow of the film for blowing .hot air to heat the film. The tenter stretches the film transversely and comprises clip bodies, clip levers and liners provided on linked chains, as well as rails composed of chain directing rail members that progressively depart away from each other and chain drive means. An oil pan is provided beneath a joint of rail members and each of the plenum ducts is provided in such a way that the hot air discharge port is not positioned immediately below the oil pan, so as to ensure that the hot air blown from the plenum duct does not make direct contact with the bottom of the oil pan.

That is, the object of the present invention can be attained by a tentering oven comprising:

a heating furnace and a tenter, said tenter transversely stretching a film, the heating furnace having a plurality of plenum ducts juxtaposed above and below the film in a direction perpendicular to a flow of the film, said plurality of plenum ducts blowing hot air to heat the film, the tenter comprising clip bodies, clip levers and liners provided on linked chains, and rails composed of chain directing rail members that progressively depart away from each other and chain drive means;

wherein:

an oil pan is provided beneath a joint of the rail members, and each of the plenum ducts is provided in such a way that a hot air discharge port of each of the plenum ducts is not positioned immediately below the oil pan so as to ensure that the hot air blown from the plenum duct does not make direct contact with a bottom of the oil pan.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Plenum ducts provided on both sides of an individual joint between clip rail members in the preheating and stretching zones of a transverse stretcher (tenter) are positioned in such a way that their discharge ports are not immediately below an oil pan but are offset from the outer edges of its bottom. In this way, one can prevent oil drops in the oil pans from flying about in the state of mist within the tentering oven while assuring uniform stretching of films in the direction of width.

Figure 4:
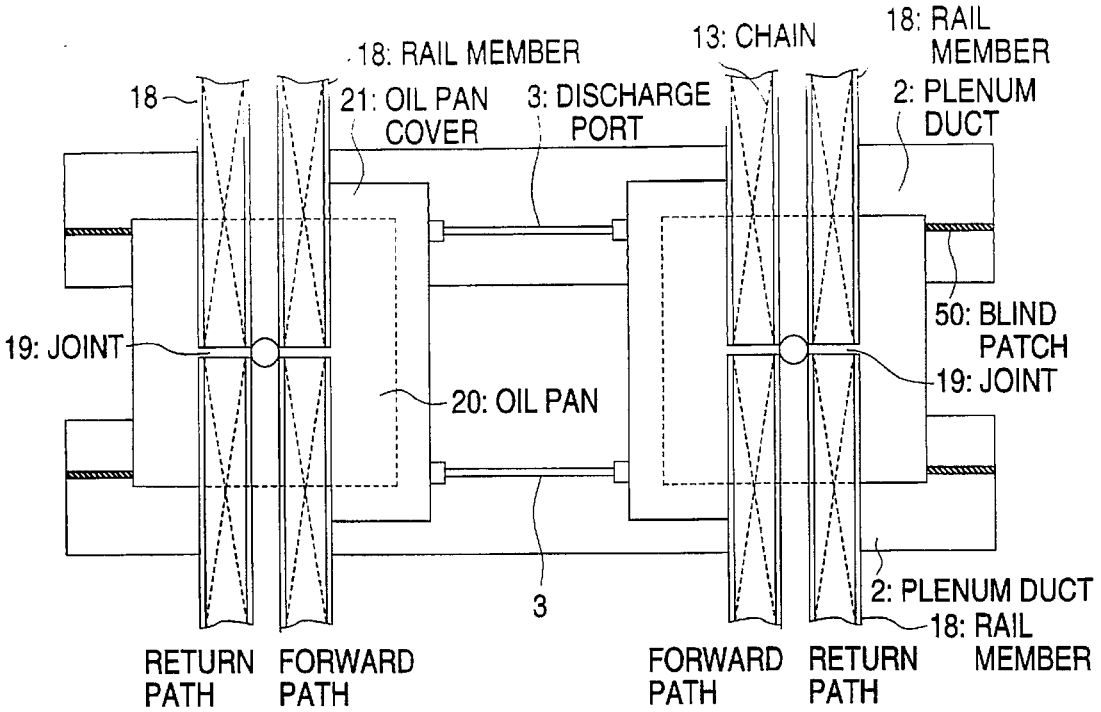
FIG. 4 is a top view of tenter rails and joints thereof.
Figure 5:
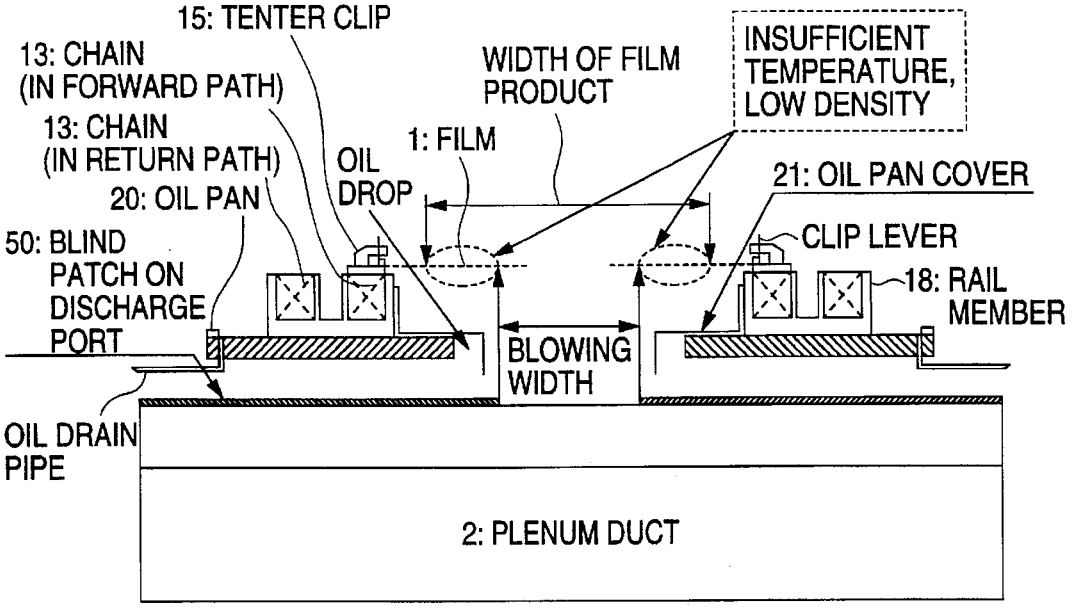
FIG. 5 is a section of FIG. 4 as taken across the joints of tenter rails.
Figure 6:
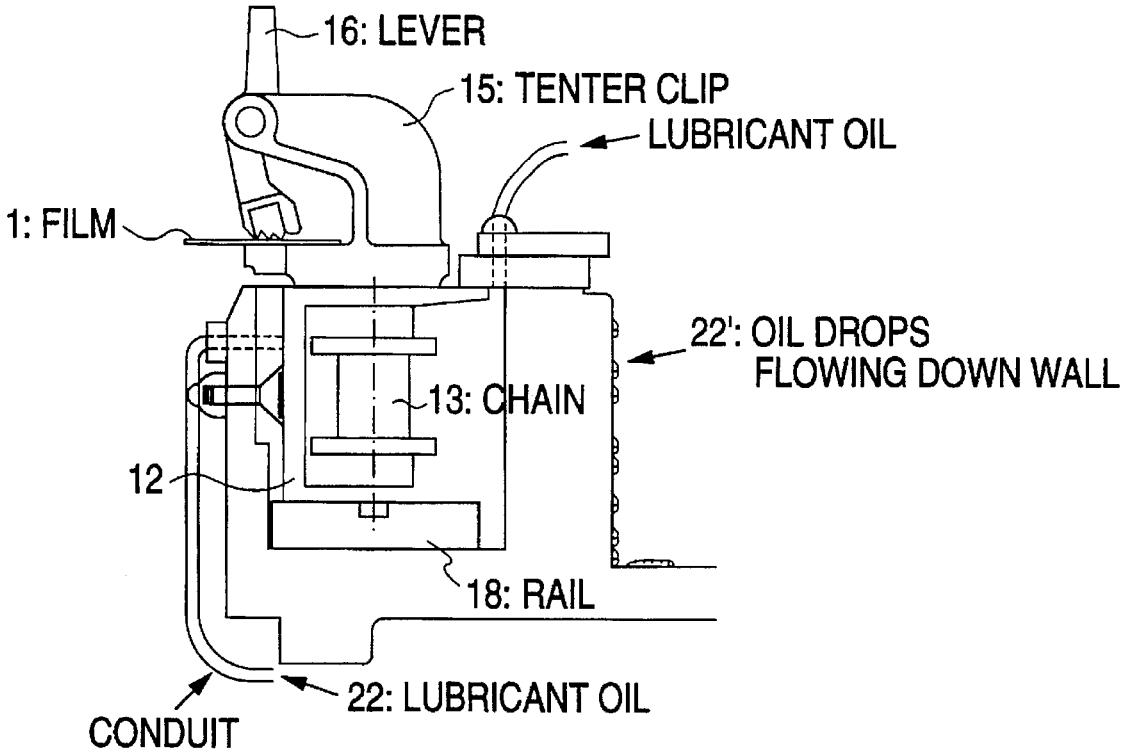
FIG. 6 shows how a lubricant oil flows in tenter rails.
Figure 8:
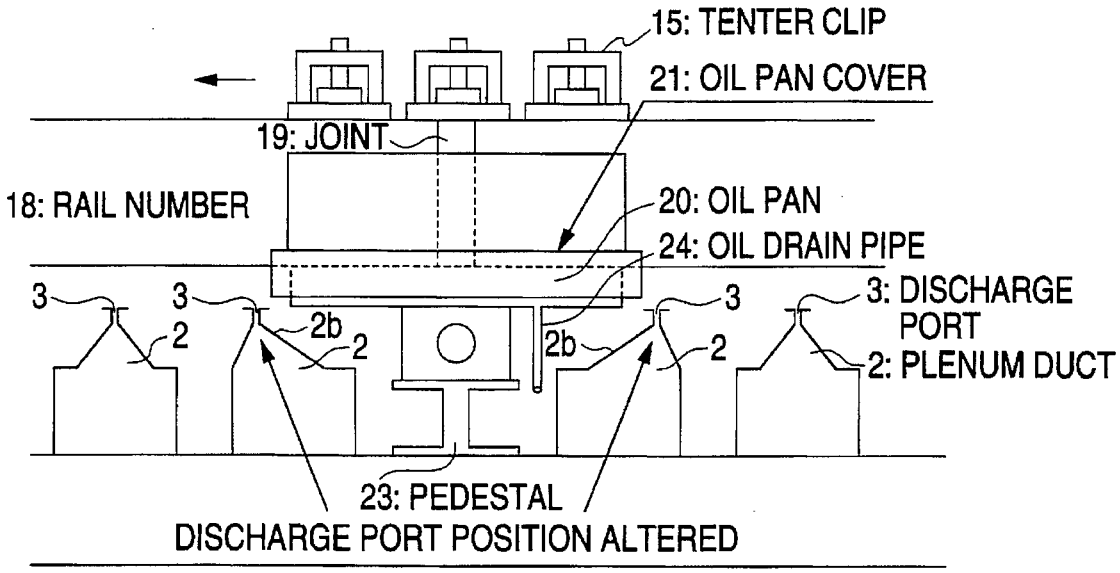
FIGS. 8(*a*) and 8(*b*) show, in both a plan and a sectional view, a joint of tenter rails in an example of the present invention.
Figure 8:
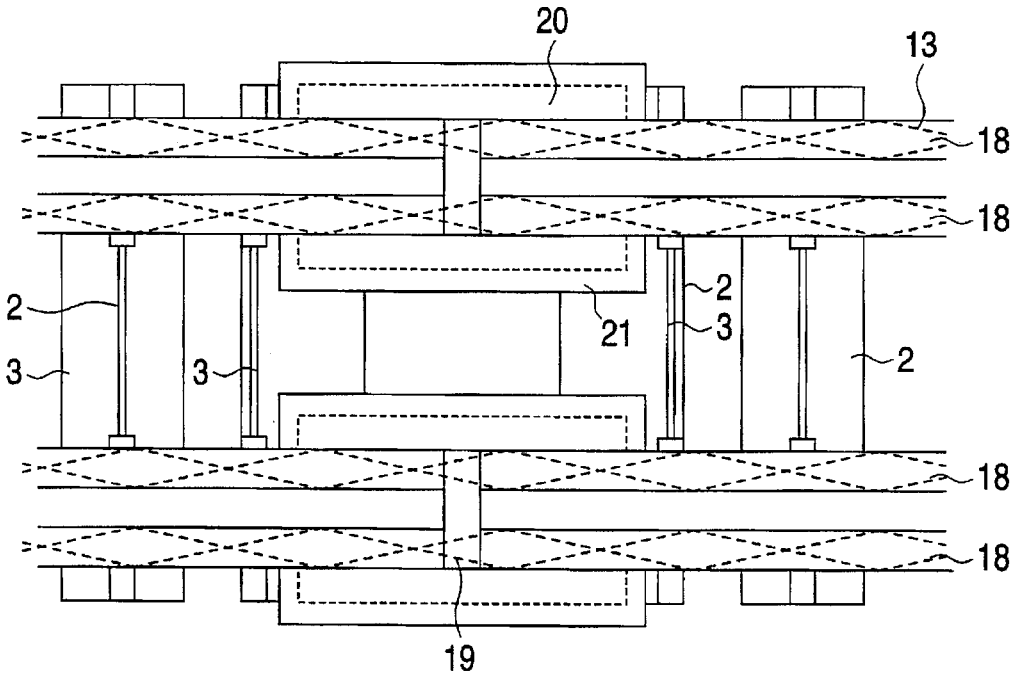

Referring to the drawings, wherein like reference numerals designate identical or corresponding parts throughout the several views, FIGS. 4, 5, 8(*a*) and 8(*b*) illustrate rail members 18 which are coupled together with a joint 19 formed therebetween; a tenter clip 15; an oil pan 20 having a cover 21 and a pedestal 23; and a plurality of plenum ducts 2 having discharge ports 3 through which hot air is blown.

As shown in FIG. 5, a film 1 is held by means of tenter clips 15 fitted on tenter rails 18 and as chains 13 run on the inner rail, the film is stretched in a transverse direction.

In the meantime, hot air as supplied from the plenum ducts 2 positioned above and below the film heats it first in a preliminary stage (80° to 150° C.), then in a final stage (150° to 170° C). After the end of the transverse stretching, the film is annealed with hotter air (170° to 175° C.) supplied from the plenumducts 2. Subsequently, the stretched film is cooled with the air (50° to 85° C.) supplied through the discharge ports of the plenum ducts; the cooled film has the edges slit off and is taken up on a windup drum (not shown).

After slitting off the edges of the stretched film, the clips are opened and return to the initial positions via the outer rail 18.

EXAMPLE

The tentering oven used in the example was of the type shown in FIGS. 8(*a*) and 8(*b*). The stretching hot air oven used 22 upper plenum ducts and an equal number of lower plenum ducts. Thirteen of these ducts were positioned at the joints of rail members; seven were above the tenter and six below. Four pairs of plenum ducts were used in the annealing hot air oven and 16 pairs of heating elements provided for 2 pairs of plenum ducts were not activated.

As illustrated in FIGS. 8(*a*) and 8(*b*), the oil pan 20 is positioned on the pedestal 23 and includes an oil drain pipe 24 which is on the side of the pedestal 23. The oil pan 20 further includes the oil pan cover 21. For the purpose of preventing oil from being spattered onto the film, the plenum ducts 2 which are positioned approximately below the oil pan 20 have a slanted upper portion 2*b*. These ducts 2 further include discharge ports 3 which are slanted in a direction away from the bottom of the oil pan 20 so as to be offset from the outer edges of the bottom of the oil pan 20. This configuration is illustrated in FIG. 8(*a*). With this construction, oil drops from the oil pan can be prevented from flying about within the tenter while at the same time assuring a uniform stretching of the film in the direction of width of the films.

A composition consisting of 90 parts by weight of polypropylene ("Mitsubishi Polypro MA-6", trade name of Mitsubishi Chemical Corporation), 10 parts by weight of high-density polyethylene ("Mitsubishi Polyethy EY-40", trade name of Mitsubishi Chemical Corporation), 10 parts by weight of calcium carbonate ("Whiton", trade name of Shiraishi Calcium Co., Ltd.), 0.1 part by weight each of three antioxidants ("Yoshinox BHT", trade name of Yoshitomi Pharmaceutical Industries, Ltd.; "Mark 329", trade name of Adeka Argus Chemical Co., Ltd.; and "Irganox 1076", trade name of Ciba-Geigy A. G.) and 0.1 part of a dispersant ("Lunax", trade name of Kao Corporation) was melt kneaded in an extruder, extruded into a film through a die at 200° C., and cooled to about 50° C. The cooled film was then heated to about 135° C. and stretched by a stretch ratio of 5 in a machine direction using the difference in peripheral speed among rolls.

In a separate step, 100 parts by weight of polypropylene ("Mitsubishi Polypro MA-6") was mixed with 80 parts by weight of calcium carbonate particles (average size: 1.5 μm), 10 parts by weight of titanium oxide particles (average size: 1 μm), 0.1 part by weight each of Yoshinox BHT and Mark 329 (antioxidants) and 0.1 part by weight of oleic acid. The resulting composition was melt kneaded in two other extruders and extruded into films through dies at 200° C. to laminate both sides of the longitudinally stretched film. The laminate was then cooled to a temperature of 50° C. and directed into a hot air oven at about 170° C., where it was reheated to about 155° C. and stretched transversely by a stretch ratio of 10 on a tenter. Subsequently, the stretched laminate was passed trough an oven at 175° C. to be heat set (the film had a temperature of 160° C.).

Figure 1:
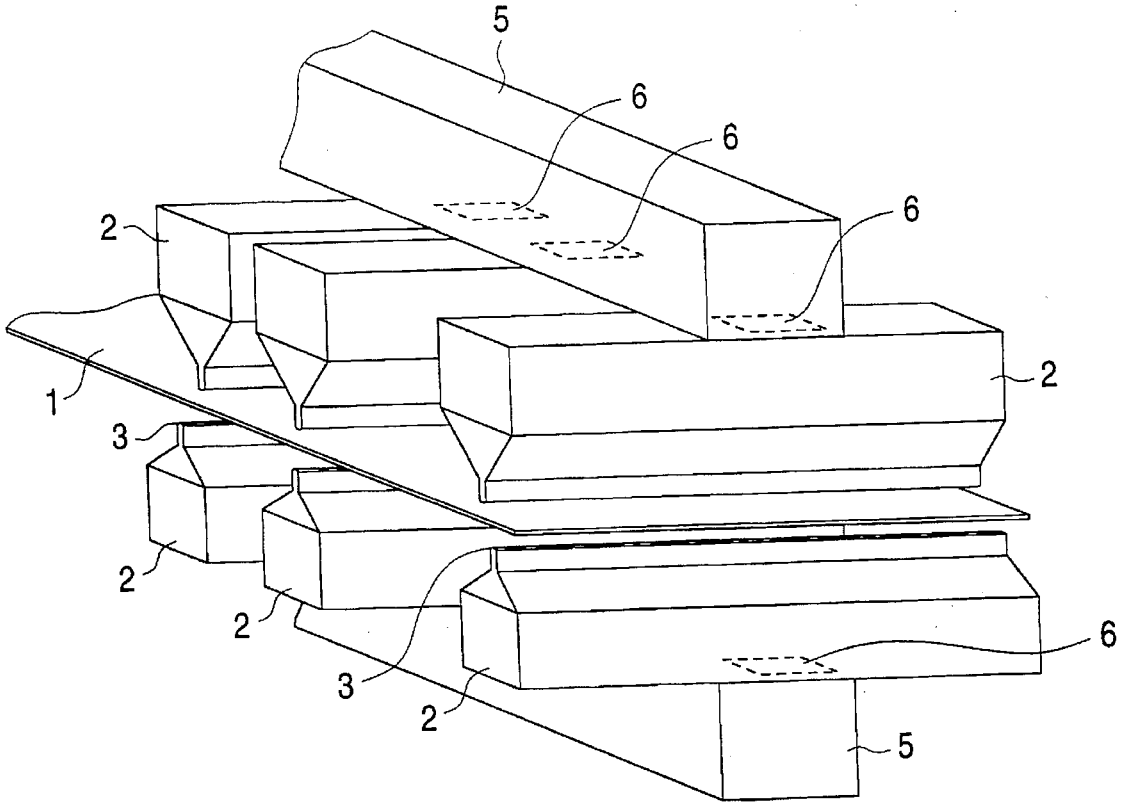
FIG. 1 is a perspective view showing the interior of a related heating oven.
Figure 2:
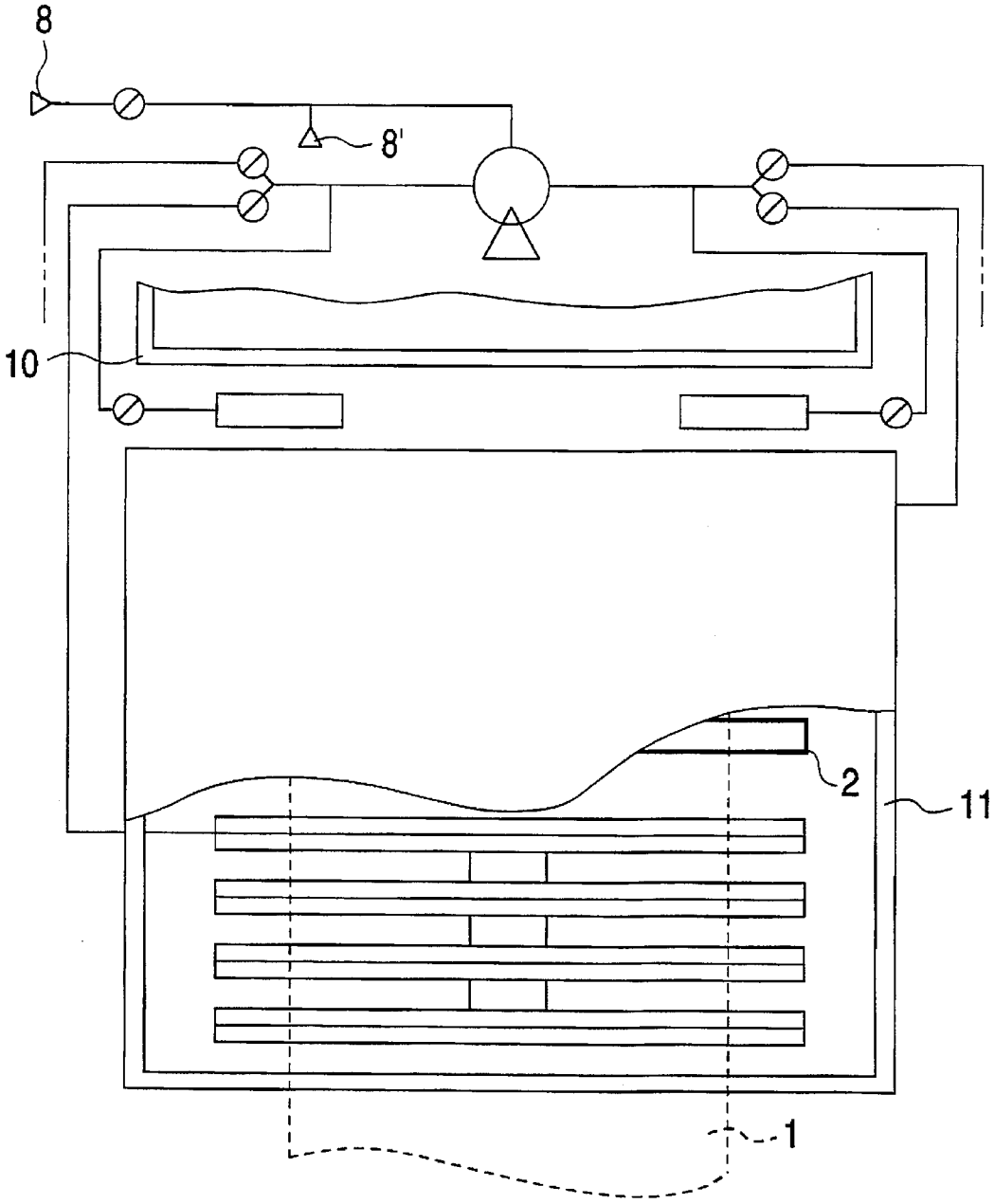
FIG. 2 is a plan view of a related annealing hot air oven.
Figure 3:
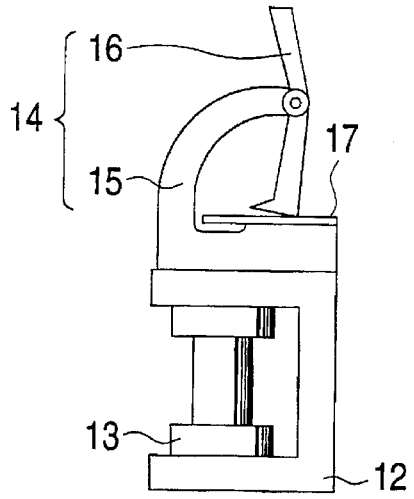
FIGS. 3(*a*) and 3(*b*) show a clip for use in a tenter or a stretching machine.
Figure 3:
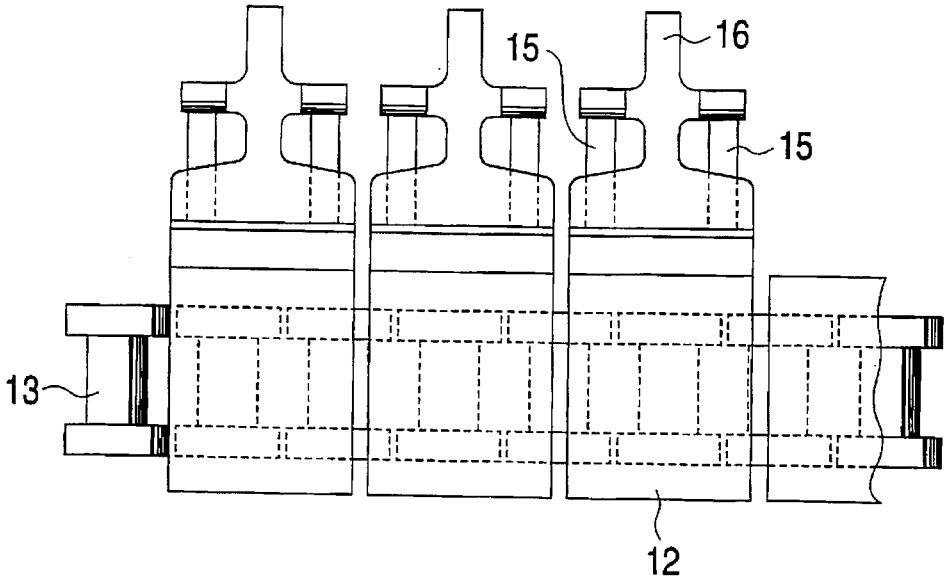

The edges of the thus heat set (annealed), biaxially stretched laminate were cooled with air. Thereafter, the laminate was directed into a cooling furnace having 8 pairs of plenum ducts (as shown in FIG. 1 in Examined Japanese Patent Publication No. 63498/1991) and the film was cooled to 45° C. with air that was discharged through the individual ducts at the same pressure of 40 mmAq. The cooled film was then subjected to corona discharge treatment (100 W/hr), had the edges slit off and wound up over a length of 500 m.

The thus produced stretched laminate had a three-layer structure with a transverse width of 300 cm, in which the biaxially stretched film forming the intermediate layer (base layer) had a thickness of 60 μm whereas the uniaxially stretched films forming the top and bottom layers each had a thickness of 10 μm. The three-layer laminate was white in color and had good printability and writability.

This laminate had an apparent density of 0.79 g/cc and contained a number of fine voids not only in the base layer but also in the top and bottom layers, which also had a number of fine cracks in the surfaces.

At the end of the wind-up operation, the winder which has taken up the laminate (synthetic paper) rotates in reverse direction so that the roll of an empty winder starts to take up the laminate, thus enabling continuous production of the synthetic paper.

The thus produced synthetic paper had an average thickens of 80 μm with variations of ±1.7 μm.

After 210 days of the operation, the synthetic paper was checked for surface fouling with oil drops and no defects due to deposited oil drops were found throughout the test period.

COMPARATIVE EXAMPLE

Figure 7:
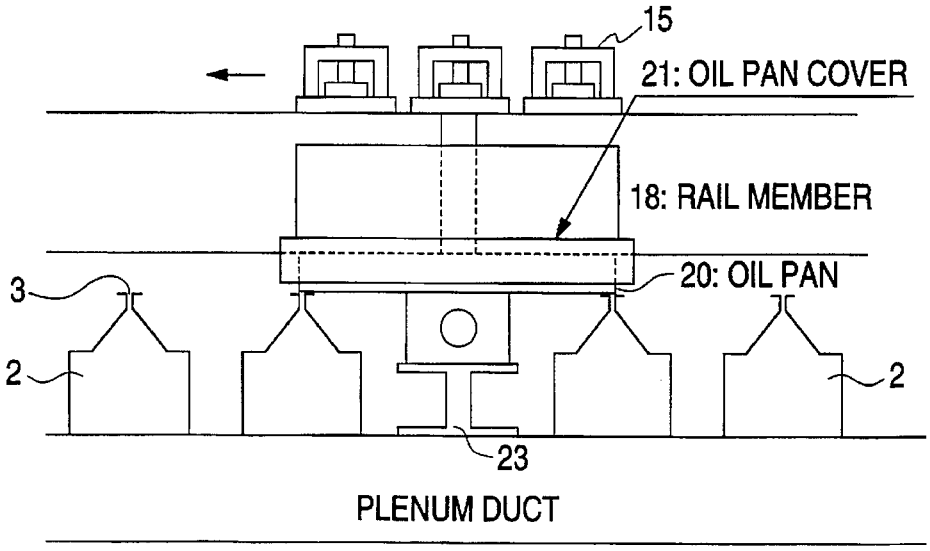
FIGS. 7(*a*) and 7(*b*) show, in both a plan and a sectional view, a joint of related tenter rails.
Figure 7:
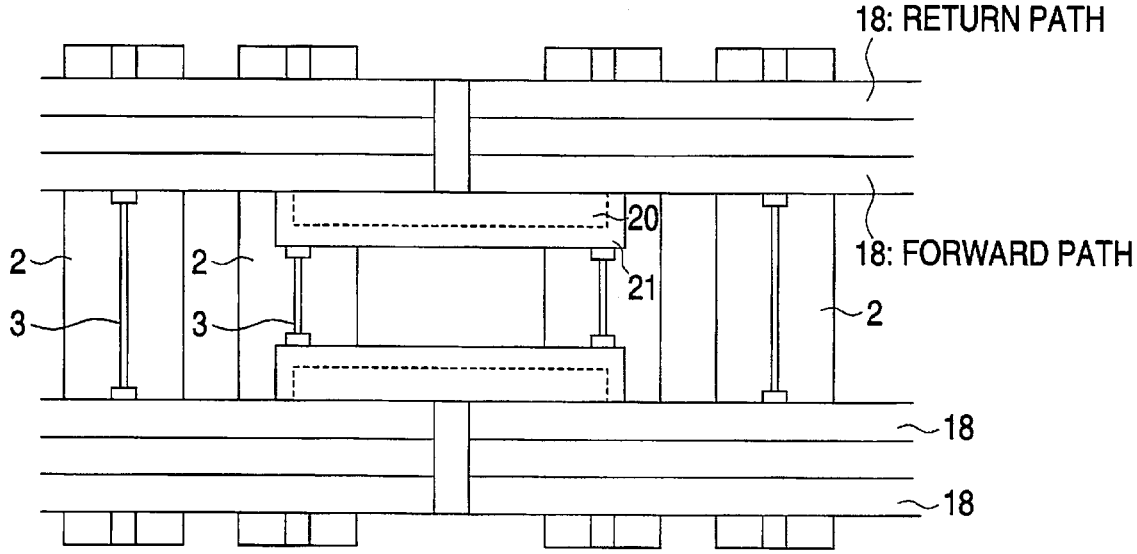

The tentering oven used in the comparative example was of the type shown in FIGS. 4, 7(*a*) and 7(*b*). Synthetic paper was produced by repeating the procedure of the example, except that the discharge ports of plenum ducts located beneath oil pans were each provided with a blind patch at both ends. On the 47th day of the operation, oil drops were detected on the synthetic paper.

The product synthetic paper had an average thickness of 80 μm with variations of ±4.0 μm.

In the structure of the present invention, oil used in lubricating the chains is collected in oil pans beneath the joints of rail members and aspirated by means of a blower such that it would flow out of the tentering oven via oil draining conduits 24 without fouling the film being stretched. The plenum ducts 2 are provided beneath the joints of rail members such that their fluid discharge ports (blow ports 3) are not positioned immediately below the oil pans. This eliminates the need to provide a blind patch at either end of each discharge port and enables efficient heating of the film, which hence can be stretched to have a uniform thickness profile in TD.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A tentering oven comprising:

a heating furnace and a tenter, said tenter transversely stretching a film, the heating furnace having a plurality of plenum ducts juxtaposed above and below the film in a direction perpendicular to a flow of the film, said plurality of plenum ducts blowing hot air to heat the film, the tenter comprising clip bodies, clip levers and liners provided on linked chains, and rails composed of chain directing rail members that progressively depart away from each other and chain drive means;

wherein:

an oil pan is provided beneath a joint of the rail members, and each of the plenum ducts is provided in such a way that a hot air discharge port of each of the plenum ducts is not positioned immediately below the oil pan so as to ensure that the hot air blown from the plenum duct does not make direct contact with a bottom of the oil pan.

2. A tentering oven according to claim 1, wherein said oil pan is positioned on a pedestal member, said oil pan comprising an oil drain pipe which extends on a side of the pedestal member.

3. A tentering oven comprising:

a tenter which transversely stretches a film;

a heating furnace including a plurality of plenum ducts for blowing hot air onto the film held by the tenter;

rail members for conveying the film through the heating furnace; and an oil pan positioned under a portion of the rail members for receiving oil drops from said rail members which flow down under gravity;

wherein plenum ducts of said plurality of plenum ducts which are positioned closest to and substantially below the oil pan have a top portion which slants away from a bottom of said oil pan such that a discharge port of each of said plenum ducts which are positioned closest to and substantially below the oil pan blow hot air away from the bottom of the oil pan and to said film.

4. A tentering oven according to claim 3, further comprising a pedestal for supporting said oil pan, said pedestal extending between said plenumducts which are positioned closest to and substantially below the bottom of said oil pan.

5. A tentering oven according to claim 3, wherein said portion of said rail members under which said oil pan is positioned is a joint of the rail members.

6. A tentering oven according to claim 3, wherein said plenum ducts extend along a widthwise direction of said film in a direction perpendicular to a travel direction of said film.

7. A tentering oven according to claim 3, wherein said film is a resin film.

8. A tentering oven according to claim 4, wherein said oil pan comprises a drain pipe extending from the bottom of said oil pan along a side of said pedestal.

9. A tentering oven comprising:

stretching means for transversely stretching a film;

heating means for heating the film held by said stretching means, said heating means comprising a plurality of hot air blowing means for blowing hot air onto the film;

conveying means for conveying the film through said heating means; and oil receiving means positioned under a portion of said conveying means for receiving oil drops from said conveying means which flow down under gravity;

wherein hot air blowing means of said plurality of hot air blowing means which are located substantially below the oil receiving means comprise a slanted top end portion which leads to a blow port means which is offset with respect to a central axis of said hot air blowing means, said offset blow port means blowing hot air in a direction away from a bottom of the oil receiving means to the film.

* * * * *